United States Patent [19]

Lewin

[11] Patent Number: 4,609,052

[45] Date of Patent: Sep. 2, 1986

[54] PNEUMATICALLY OPERATED BURROWING TOOL

[76] Inventor: Stephen S. Lewin, 3530 Tuxedo Rd., Mound, Minn. 55364

[21] Appl. No.: 676,308

[22] Filed: Nov. 29, 1984

[51] Int. Cl.[4] ..... E21B 1/00

[52] U.S. Cl. ..... 173/91; 175/19

[58] Field of Search ..... 173/91, 116, 137, 17; 175/19; 91/234, 235

[56] References Cited

U.S. PATENT DOCUMENTS

| | | | |
|---|---|---|---|
| 3,137,483 | 6/1964 | Zinkiewicz | 173/91 |
| 3,616,865 | 11/1971 | Sudnishnikov | 173/91 |
| 3,651,874 | 3/1972 | Sudnishnikov et al. | 173/91 |
| 3,705,633 | 12/1972 | Sudnishnikov et al. | 173/91 |
| 3,756,328 | 9/1973 | Sudnishnikov et al. | 173/91 |
| 3,995,702 | 12/1976 | Klimashko et al. | 173/91 |
| 4,132,277 | 1/1979 | Tupitsyn et al. | 173/91 |

*Primary Examiner*—Frank T. Yost
*Assistant Examiner*—Hien H. Phan
*Attorney, Agent, or Firm*—Paul L. Sjoquist

[57] ABSTRACT

A burrowing tool having a pneumatically reciprocable piston hammer concentrically slidable about an adjustable valve sleeve, wherein the valve sleeve may be positioned to cause the piston hammer to impact against either a forward or a rearward anvil, with position mechanism including a threaded and slotted reversing screw removably fitted into the rearward end cap of the tool, the slotted portions of the reversing screw serving as a plurality of exhaust ports, wherein the end cap is sized to permit removal of the valve and inner mechanism upon removal of the reversing screw from the tool.

15 Claims, 4 Drawing Figures

PNEUMATICALLY OPERATED BURROWING TOOL

BACKGROUND OF THE INVENTION

The present invention relates generally to pneumatically reciprocable burrowing tools, having an adjustable capability for forwardly or rearwardly burrowing through soil. More particularly, the invention relates to an improved burrowing tool design which permits an overall reduction in tool size without loss of the reversible drive qualities of the burrowing tool.

Pneumatically operated burrowing tools are well known in the art, usually operating on the principle of pneumatically reciprocating a piston hammer against an anvil to create a mechanical shock impact, the direction of such impact causing perceptible movement of the tool through soil. When the mechanical shock impact is driven in a direction toward the front of the tool the tool movement is forwardly into the soil, and when the mechanical shock impact is delivered in a direction towards the rear of the tool the tool movement through the soil is rearwardly. Such tools have been developed wherein the hammer drive mechanism may be selectively adjusted to cause the tool to move in either direction, thereby permitting the use of the tool for burrowing a tunnel through the soil in one direction, and reversing the action of the tool so as to permit the tool to back out of the tunnel to the point of beginning. The prior art shows various mechanical adaptations for accomplishing this reversing function, usually by controlling the stroke of the piston hammer so as to permit a shock impact at either a forwardly positioned anvil or a rearwardly positioned anvil inside of the tool.

Since such tools are pneumatically operated, it is necessary that they be coupled to a pressurized air hose, and a source of pressurized air be connected into the hose for providing the necessary driving energy. The valving mechanism inside of the tool usually permits the pressurized air in the hose to be directed to drive the piston hammer in a first direction, exhausting air through the rear end of the tool, and also to passages for driving the piston hammer in a reverse direction. Therefore, during each complete stroke of the piston hammer there is a force stroke wherein pressurized air moves the piston against an anvil and a return stroke wherein pressurized air returns the piston to an initial position. During each stroke air is exhausted from the rear of the device. The exhaust air is typically directed through holes at the rear of the device into the soil or into the tunnel which has been created by operation of the device.

The valving mechanism inside the tool which typically regulates the forward and reverse strokes of the piston may be adjusted in some pneumatic burrowing tools to permit reversible operation. In such tools, the valving mechanism may be adjusted to a first position permitting reciprocable motion of the piston hammer over a predetermined stroke, so as to cause the hammer to impact against a forward anvil. The valving mechanism may be repositioned to a second position wherein the piston hammer is reciprocable over a predetermined stroke, such that the piston hammer impacts against a rearward anvil. In such tools, the impact of the hammer against the forward anvil causes forward motion of the burrowing tool through soil, and the impact of the hammer against the rearward anvil causes rearward motion of the tool through soil. One of the design approaches utilized for enabling the selective positioning of the valving mechanism is an interior threaded portion in the tool which engages a threadable sleeve coupled to a spool valve, and also engages an air hose connected to the tool. This mechanism permits the valving mechanism to be threadably shifted along the tool axis by twisting the air hose a predetermined number of turns, which can be accomplished by an operator located at some distance from the burrowing tool, but having access to the air hose for purposes of twisting it.

In all burrowing tools known in the prior art the pressurized air applied to the tool for purposes of impacting the tool in either a forward or reverse direction is exhausted through the rear of the tool into the soil. The exhaust function is controlled by the same valving mechanism as controls the driving function, internal passages in the tool permit the exhaust air to escape through the rear end cap of the tool. Since these exhaust passages are provided in the body of the tool itself, the overall size of the tool must be made large enough to accommodate these passages, as well as to accommodate the driving piston and valving mechanism. At the same time, the tool size must be made large enough to withstand the impact forces which are developed inside the tool, necessarily compensating for the loss of material caused by forming the exhaust passages.

SUMMARY OF THE INVENTION

The invention includes a pneumatically operated burrowing tool which may be constructed of a smaller diameter than prior art tools because of the novel location of exhaust passages in the tool, which exhaust passages do not create inherent structural weaknesses in the tool. Further, the invention includes a novel valving mechanism which not only permits reversible operation of the tool by axial positioning of a threaded valve reversing screw, but also provides exhaust passages through axial slots in the valve reversing screw. Further, the invention includes a valving mechanism which may be entirely removed from the tool without disassembly of the tool end cap, and the valving mechanism includes a flexible portion which prevents jamming of the valving mechanism against the slidable piston hammer even in cases of extreme bending stresses against the tool.

It is a principal object of the present invention to provide a novel valving mechanism for pneumatically operating a burrowing tool which permits an overall reduction in size of the burrowing tool without loss of the tool driving function.

It is another object of the invention to provide a burrowing tool having a simple valving mechanism which may be removable without disassembly of the entire tool.

It is a further object of the present invention to provide a valving mechanism which provides forward and rearward control over the tool under extreme bending stresses which may be encountered by the tool in the soil.

It is another object to provide a burrowing tool which may be simply and economically constructed and may be maintained and repaired easily, through use of simple and inexpensive components.

BRIEF DESCRIPTION OF THE DRAWINGS

The foregoing improvements and advantages will become apparent from the following specification and claims, and with reference to the drawings, in which:

DESCRIPTION OF THE PREFERRED EMBODIMENT

Figure 1:
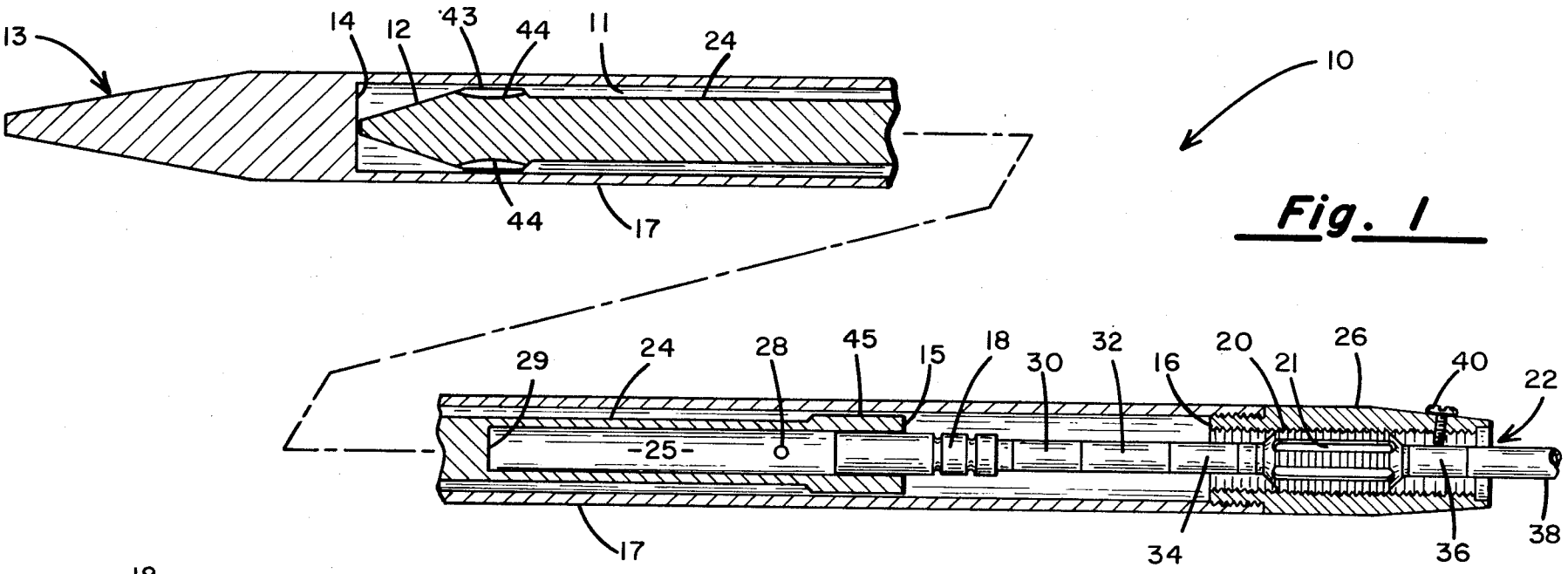
FIG. 1 shows a cross sectional view of the invention.

Referring first to FIG. 1, there is shown a cross sectional side view of the invention, wherein the internal valving mechanism is set for forward driving motion of burrowing tool 10 through soil. Burrowing tool 10 has an internal bore 11 which may be formed by a number of constructional techniques. The front end 13 of tool 10 is preferably shaped into a conical or pointed end for ease of burrowing through the ground. Front end 13 may be secured by welding or threadable coupling to the main body 17 of tool 10. The rear interior face of front end 13 forms a forward anvil 14. Tool 10 has a rear end cap 26 which is preferably threaded to main body 17 and which may be threadably removed for certain maintenance and repair purposes. End cap 26 has a rearward opening facing the rear end 22 of tool 10.

A slidable piston assembly 24 is located in bore 11. The front end of piston assembly 24 is formed into a hammer 12, which hammer 12 is designed for impacting against forward anvil 14. The rearward end of piston assembly 24 is formed into a hammer surface 15, which hammer surface 15 is designed for impacting against rearward anvil surface 16. Rearward anvil surface 16 is formed at the forward interior edge of end cap 26. The overall length of piston assembly 24 is selected to be shorter than the interior length of bore 11, so as to permit reciprocable sliding motion of piston assembly 24 within bore 11. Piston assembly 24 has an interior bore 25, which bore 25 opens through the rear edge of piston assembly 24, but terminates prior to the end of front hammer 12. Piston assembly 24 has a plurality of ports 28 passing from bore 25 through the outside surfaces of piston assembly 24. Ports 28 are positioned somewhat forward of the rear opening of bore 25, and are forwardly positioned relative to a valve sleeve 18 when forward hammer 12 contacts forward anvil 14. Valve sleeve 18 is slidably fitted into bore 25, so as to sealably close ports 28 during a portion of the stroke of piston assembly 24. Valve sleeve 18 is the preferably constructed of nylon or comparable plastic material, and it may include a plurality of circumferential grooves for containment of oil.

Piston assembly 24 is constructed for slidable movement within bore 11, along the axis of burrowing tool 10. Piston assembly 24 has a forward raised circumferential shoulder 43 which is sized larger than the body of piston assembly 24, but smaller than the internal diameter of bore 11, so as to slidably guide piston assembly 24 within bore 11. Similarly, piston assembly 24 has a raised rear circumferential shoulder 45 for slidably guiding the piston assembly within bore 11. The center portion of piston assembly 24 is therefore of lesser diameter than is shoulder 43 and shoulder 45. Further, shoulder 43 has several axial grooves 44 passing across its length so as to permit the free flow of air which would otherwise be entrapped within bore 11 during the movement of piston assembly 24.

Valve sleeve 18 is fixedly attached to a coupler 30, and coupler 30 is clamped to a small section of high pressure hose 32. The rearward end of hose section 32 is connected to a further coupler 34, which is threadably attached to a valve reversing screw 20. Valve reversing screw 20 has a threadable exterior surface which is engageable against similar threads on the interior of end cap 26. A further coupler 36 is threadably attached at the rear end of valve reversing screw 20, and coupler 36 is also fixedly attached to high pressure air hose 38. Couplers 30 and 34 and hose section 32 may be formed of conventional hose fittings, wherein couplers 30 and 34 have ends adapted for tightly clamping against hose section 32, and have further ends for threadably attaching to valve sleeve 18, in the case of coupler 30, and to valve reversing screw 20, in the case of coupler 34. Similarly, coupler 36 may be a conventional hose coupling link, having an end adapted for tightly connecting against hose 38 and a forward end for threadably attaching into valve reversing screw 20.

Figure 2:
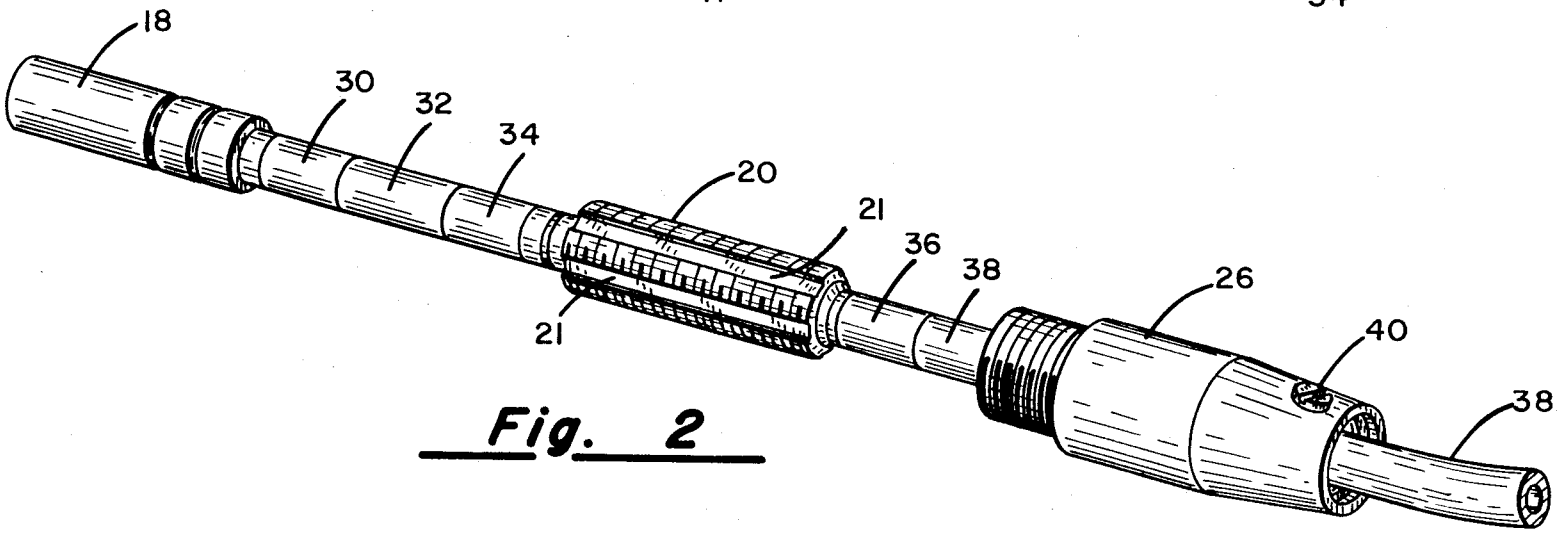
FIG. 2 shows an isometric view of the valving mechanism.

FIG. 2 shows an isometric view of the valving mechanism here and above described, in partial disassembled form. End cap 26 may be threadably disengaged from valve reversing screw 20, and from connection with main body 17. Conversely, air hose 38 may be twisted to threadably disengage valve reversing screw 20 rearwardly through end cap 26, providing set screw 40 is first removed from interference with the threadable disengagement of valve reversing screw 20. It should be noted that the external diameter of valve reversing screw 20 is larger than the external diameter of valve sleeve 18. This permits the entire assembly comprising valve sleeve 18, hose section 32 and couplers 30 and 34, valve reversing screw 20, to be threadably removed from within burrowing tool 10 by unthreading it through end cap 26.

Figure 3:
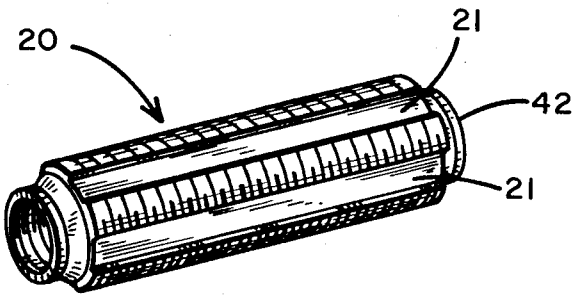
FIG. 3 shows an isometric view of the valve reversing screw.

FIG. 3 shows an isometric view of valve reversing screw 20. A plurality of axial slots 21 are cut through the external threaded portion of valve reversing screw 20, to thereby provide exhaust ports for the passage of air out the rear end 22 of tool 10. Valve reversing screw 20 has respective internal threaded ends 41 and 42 for receiving hose couplers 34 and 36, and a bore is formed throughout the entire axial length of valve reversing screw 20 to provide a passage for pressurized air via air hose 38.

Figure 4:
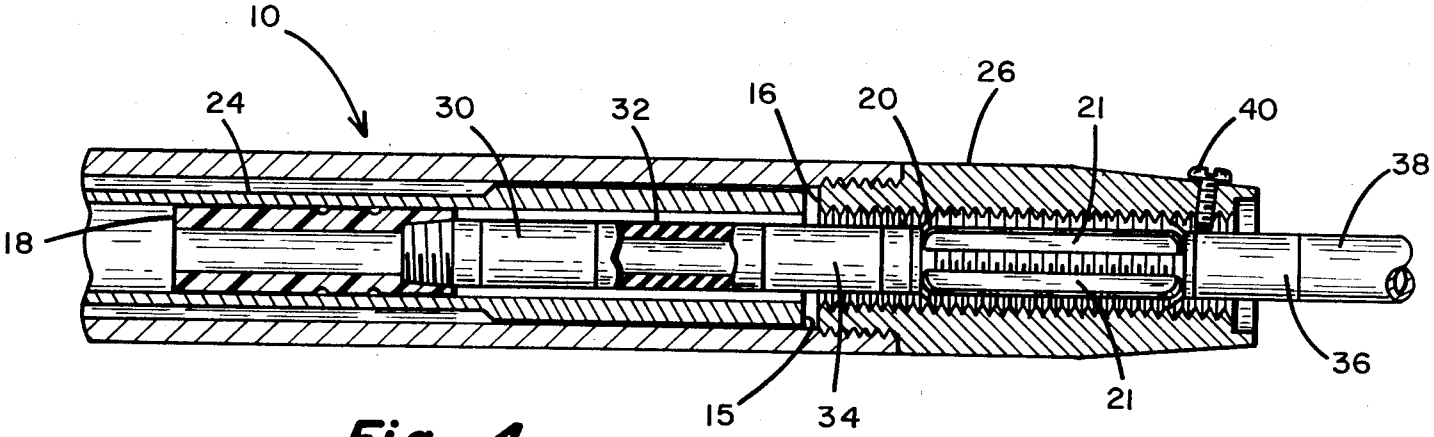
FIG. 4 shows a partial cross sectional view of the invention in a second driving position.

FIG. 4 shows a partial cross sectional view of tool 10, showing valve reversing screw 20 in its rearmost threadable position with end cap 26. In this position, the rear edge of valve reversing screw 20 comes into interference contact against set screw 40, thereby preventing any further rearward threading action. In the position shown in FIG. 4, valve sleeve 18 is in its most rearward position, and therefore piston assembly 24 can move rearwardly so as to contact end cap 26. In other words, the rearmost position of valve reversing screw 20 axially moves the valving mechanism, including valve sleeve 18 so as to permit rearward impacting by rear hammer 15 against rear anvil 16, and the resulting direction of motion of burrowing tool 10 will be rearward.

In operation, for forward motion of burrowing tool 10, hose 38 is twisted to threadably direct valve reversing screw 20 in a forwardly direction, to a position approximately as shown in FIG. 1. When valve reversing screw 20 is in this position, valve sleeve 18 is likewise forwardly positioned, and piston assembly 24 must move forwardly into contact against forward anvil 14 before ports 28 become uncovered by valve sleeve 18. In the position shown in FIG. 1, when pressurized air is applied to hose 38 it passes through the interior passages created through valve reversing screw 20, coupler 34, hose section 32, coupler 30, and valve sleeve 18. Pressurized air is relieved outwardly through ports 28, and acts against the shoulder 45 which is formed on the outer circumferential surface of piston assembly 24. The pressurized air acting against the surface area of shoulder 45 causes a net rearward force, thereby driving piston assembly 24 rearwardly within bore 11. Rearward motion continues until ports 28 slide pass the blocking surface of valve sleeve 18 and at that instant the pressurized air flow into bore 11 is blocked. Simultaneously, the pressurized air becomes confined within the forward portion of bore 25 and thereby creates a net forward force against the interior surface 29 of bore 25. This pressure acts against the area of surface 29 and stops the rearward motion of piston assembly 24 and causes a net forward drive force. The net forward drive force causes piston assembly 24 to move sharply forward until front hammer 12 impacts against forward anvil 14. During this forward travel ports 28 once again become exposed and the air pressure becomes relieved as hereinbefore described, causing piston assembly 24 to reverse its stroke.

In operation, for rearward motion of burrowing tool 10, hose 38 is twisted to threadedly direct valve reversing screw 20 in a rearwardly direction, to a position approximately as shown in FIG. 4. When valve reversing screw 20 is in this position, valve sleeve 18 is likewise rearwardly positioned, and piston assembly 24 must move rearwardly into contact against rear anvil 16. In the position shown in FIG. 4, when pressurized air is applied to hose 38 it passes into the chamber formed by bore 25 and exerts a net forward force against piston assembly 24. This net forward force causes piston assembly 24 to move forwardly in a manner similar to that described hereinbefore. After ports 28 become exposed away from valve sleeve 18 piston assembly 24 reverses its direction, and the net rearward drive force is sufficiently large to cause the piston assembly 24 to sharply contact rearward anvil 16. During its rearward motion, piston assembly 24 comes into closing relationship against valve sleeve 18 and the air pressure into bore 25 again causes reversal of motion of piston assembly 24.

In either the forward or rearward drive motion it is apparent that the axial position of valve sleeve 18 determines the relative stroke of piston assembly 24 within bore 11. It has been found that valve sleeve 18 may be positioned at any axial position determined by the full threadable range of valve reversing screw 36 within end cap 26. In any case, the air pressure which is developed within bore 11 for the purpose of driving piston assembly 24 is exhausted through the axial slots 21 in valve reversing screw 20. Slots 21 therefore act as relief ports for relieving air which would otherwise be entrapped within burrowing tool 10 during the respective driving strokes of piston assembly 24.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A pneumatically operated burrowing tool adapted for burrowing holes in earth, comprising (a) a tubular housing having a reduced diameter front end cap and a rear end cap, all along a common axis, and said rear end cap having a threaded bore therethrough about said axis;

(b) a slidable piston in said tubular housing, said piston having a partial internal bore opening toward said rear end cap; and a valve port through said piston opening into said internal bore; and an enlarged diameter rear shoulder about said said piston rearward of said valve port, said enlarged diameter rear shoulder adapted for sliding contact against said tubular housing; said piston having a front end and a rear end and being slidable in said tubular housing between a maximum forward position wherein said piston front end contacts said front end cap, and a maximum rearward position wherein said piston rear end contacts said rear end cap;

(c) a hollow spool valve in said internal bore opening;

(d) a valve reversal screw having an external threaded surface in said end cap threaded bore, said screw having an axial bore therethrough; and at least one slot axially aligned between the external threaded surface of said valve reversal screw and the end cap threaded bore; said valve reversal screw being axially threadably movable between a first forward position and a second rearward position; and (e) an air hose attached to said valve reversal screw, and an air coupling connected between said valve reversal screw and said spool valve; whereby when said valve reversal screw is in its first forward position said spool valve uncovers said valve port to cause said piston to move rearward from its maximum forward position, and when said valve reversal screw is in its second rearward position said spool valve covers said valve port to cause said piston to move forward from its maximum rearward position, all under the influence of pressurized air applied through said air hose and exhausted through said at least one slot.

2. The apparatus of claim 1 wherein each of said spool valve and said valve reversal screw has an external diameter and said spool valve has an external diameter which is less than the external diameter of said valve reversal screw.

3. The apparatus of claim 2, wherein said valve reversal screw further comprises a plurality of slots axially aligned in the external threaded surface of said valve reversal screw.

4. The apparatus of claim 3, wherein said rear end cap is threadably attached to said housing.

5. The apparatus of claim 1 wherein said air coupling further comprises a segment of air hose.

6. The apparatus of claim 1 wherein said piston further comprises an enlarged diameter rear shoulder and an enlarged diameter front shoulder, said shoulders adapted for sliding contact against said tubular housing.

7. The apparatus of claim 6, further comprising axial grooves in said enlarged diameter front shoulder.

8. The apparatus of claim 7, wherein said piston further comprises a reduced diameter end toward said housing front end cap.

9. A burrowing tool adapted for operation by connection to a source of compressed air, comprising (a) a tubular housing extending along an axis and having a closed and reduced diameter front end and an open rear end;

(b) a piston slidably positioned in said housing said piston having a closed front end and a rear end having a bore therein, with a valve port passing through said piston into said bore;

(c) an end cap threadably attached to said tubular housing rear end, said end cap having a threaded bore therethrough along said axis;

(d) a valve reversing screw threadably attached in said threaded bore in said end cap, said valve reversing screw having at least one slot extending axially along its threaded surface and said valve reversing screw having an axial bore therethrough;

(e) an air hose attached to a first end of said valve reversing screw and being adapted for coupling to said source of compressed air;

(f) a hollow spool in said piston bore; and (g) an air coupler extending between a second end of said valve reversing screw and said hollow spool valve; whereby said valve reversing screw is threadably movable from a forward position wherein said hollow spool uncovers said valve port to cause rearward movement of said piston away from said housing front end, to a rear position wherein said hollow spool covers said valve port to cause forward movement of said piston away from said end cap, said at least one slot providing a compressed air exhaust.

10. The apparatus of claim 9 wherein each of said spool valve and said valve reversing screw has an external diameter and said spool valve has an external diameter which is less than the external diameter of said valve reversing screw.

11. The apparatus of claim 10 wherein said air coupling further comprises a segment of air hose.

12. The apparatus of claim 11 wherein said piston further comprises an enlarged diameter rear shoulder and an enlarged diameter front shpulder, said shoulders adapted for sliding contact against said tubular housing.

13. The apparatus of claim 12, further comprising axial grooves in said enlarged diameter front shoulder.

14. The apparatus of claim 13, wherein said piston further comprises a reduced diameter end toward said housing front end cap.

15. The apparatus of claim 14, wherein said valve reversing screw further comprises four slots axially aligned in the external threaded surface of said screw.

* * * * *